US010755619B2

(12) United States Patent
Saito et al.

(10) Patent No.: US 10,755,619 B2
(45) Date of Patent: Aug. 25, 2020

(54) DISPLAY DEVICE, PROGRAM, AND DISPLAY METHOD FOR CONTROLLING RELATIONSHIP BETWEEN AMBIENT ILLUMINANCE AND DISPLAY LUMINANCE

(71) Applicant: EIZO Corporation, Ishikawa (JP)

(72) Inventors: Shinji Saito, Ishikawa (JP); Kengo Miyamoto, Ishikawa (JP); Keita Asahi, Ishikawa (JP)

(73) Assignee: EIZO Corporation, Ishikawa (JP)

( * ) Notice: Subject to any disclaimer, the term of this patent is extended or adjusted under 35 U.S.C. 154(b) by 0 days.

(21) Appl. No.: 16/483,924

(22) PCT Filed: Jul. 4, 2017

(86) PCT No.: PCT/JP2017/024465
§ 371 (c)(1),
(2) Date: Aug. 6, 2019

(87) PCT Pub. No.: WO2018/150602
PCT Pub. Date: Aug. 23, 2018

(65) Prior Publication Data

US 2019/0392745 A1 Dec. 26, 2019

(30) Foreign Application Priority Data

Feb. 14, 2017 (WO) ..... PCT/JP2017/005324

(51) Int. Cl.
*G09G 3/30* (2006.01)
*G09G 3/36* (2006.01)
(Continued)

(52) U.S. Cl.
CPC ..... *G09G 3/20* (2013.01); *G09G 5/10* (2013.01); *G09G 2320/0626* (2013.01); *G09G 2330/021* (2013.01)

(58) Field of Classification Search
CPC ..... G09G 2320/0276–106; G09G 3/30–3291
See application file for complete search history.

(56) References Cited

U.S. PATENT DOCUMENTS 6,337,675 B1 1/2002 Toffolo et al.
2005/0219394 A1 10/2005 Du et al.
(Continued)

FOREIGN PATENT DOCUMENTS

JP H06-308891 A 11/1994
JP H11-316566 A 11/1999
(Continued)

OTHER PUBLICATIONS

International Search Report dated Sep. 19, 2017 in corresponding International Application No. PCT/JP2017/024465; 2 pgs.

*Primary Examiner* — Sanghyuk Park
(74) *Attorney, Agent, or Firm* — Maier & Maier, PLLC

(57) ABSTRACT

A display device, program, and display method that even if the luminance is changed with respect to the previously set relationship between the ambient illuminance and the luminance of a display, are able to suppress a change in the previous relationship. A display device includes a display, an illuminance acquisition unit configured to acquire an ambient-light illuminance that is an illuminance of ambient light, a relationship acquisition unit configured to acquire a relationship between the ambient-light illuminance and a luminance of the display, a controller configured to control the relationship, and a setting unit configured to set a first set point and a second set point. The first set point is a point specified by a luminance set at an illuminance equal to or greater than a particular illuminance Is and the illuminance.

12 Claims, 12 Drawing Sheets

FIRST EMBODIMENT

(51) Int. Cl.
*G09G 3/20* (2006.01)
*G09G 5/10* (2006.01)

(56) References Cited

U.S. PATENT DOCUMENTS

| | | | | |
|---|---|---|---|---|
| 2007/0013979 | A1* | 1/2007 | Nose | G09G 3/3685 358/519 |
| 2009/0262063 | A1 | 10/2009 | Fujine et al. | |
| 2010/0188325 | A1 | 7/2010 | Inoue | |
| 2011/0148942 | A1* | 6/2011 | Furihata | G09G 5/003 345/690 |
| 2014/0340580 | A1* | 11/2014 | Nakamura | G09G 5/06 348/655 |
| 2015/0262537 | A1* | 9/2015 | Huang | G09G 3/3688 345/690 |
| 2017/0092181 | A1* | 3/2017 | Nishimura | G09G 3/3696 |

FOREIGN PATENT DOCUMENTS

| | | | |
|---|---|---|---|
| JP | 2000-047629 | A | 2/2000 |
| JP | 2001-215945 | A | 8/2001 |
| JP | 2001-522058 | A | 11/2001 |
| JP | 2002-323690 | A | 11/2002 |
| JP | 2005-304027 | A | 10/2005 |
| WO | 2006/129627 | A1 | 12/2006 |
| WO | 2007/055131 | A1 | 5/2007 |
| WO | 2013/099351 | A1 | 7/2013 |

* cited by examiner

FIRST EMBODIMENT

Fig. 3 FIRST EMBODIMENT
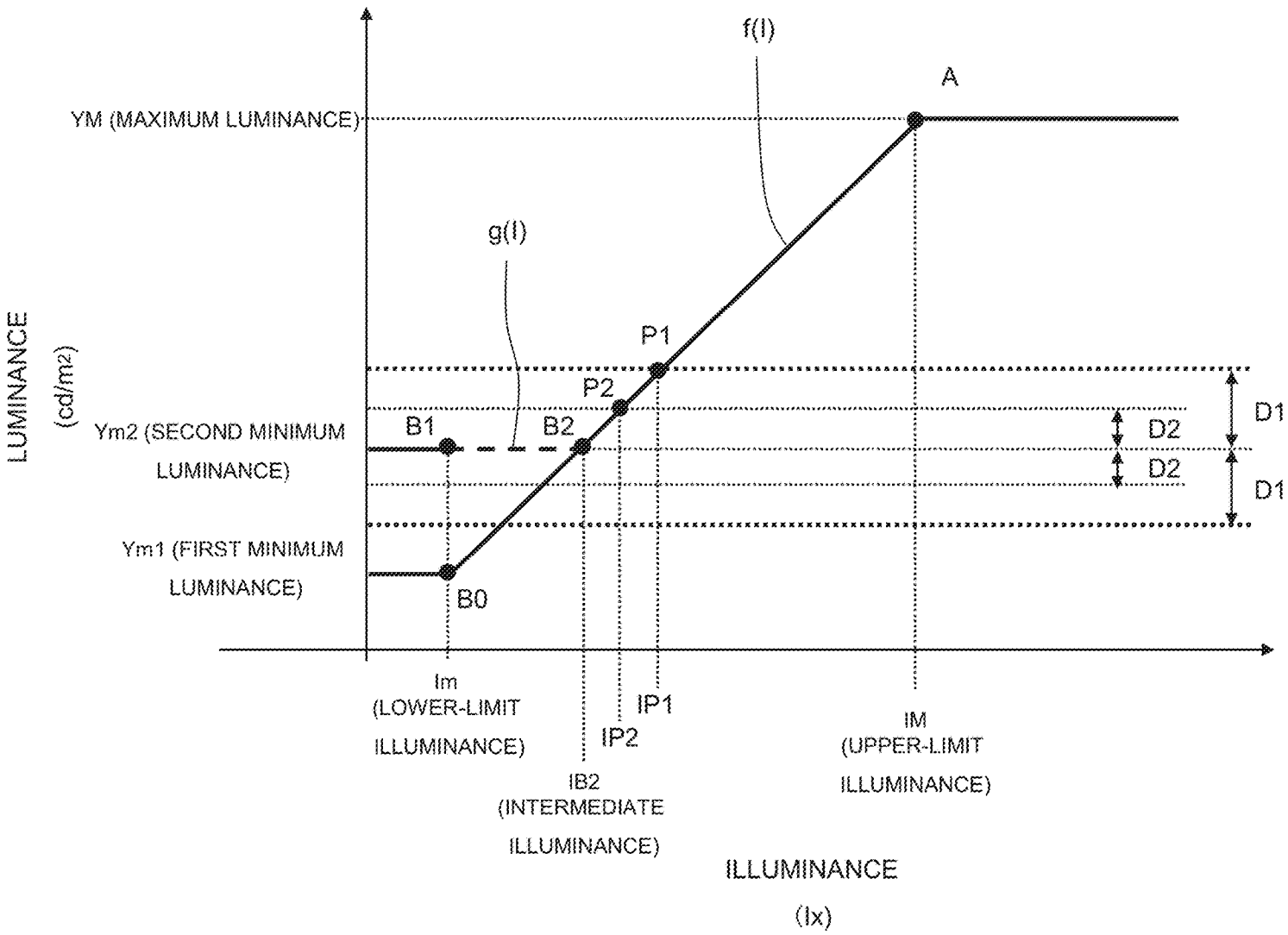

Fig. 4 MODIFICATION 1
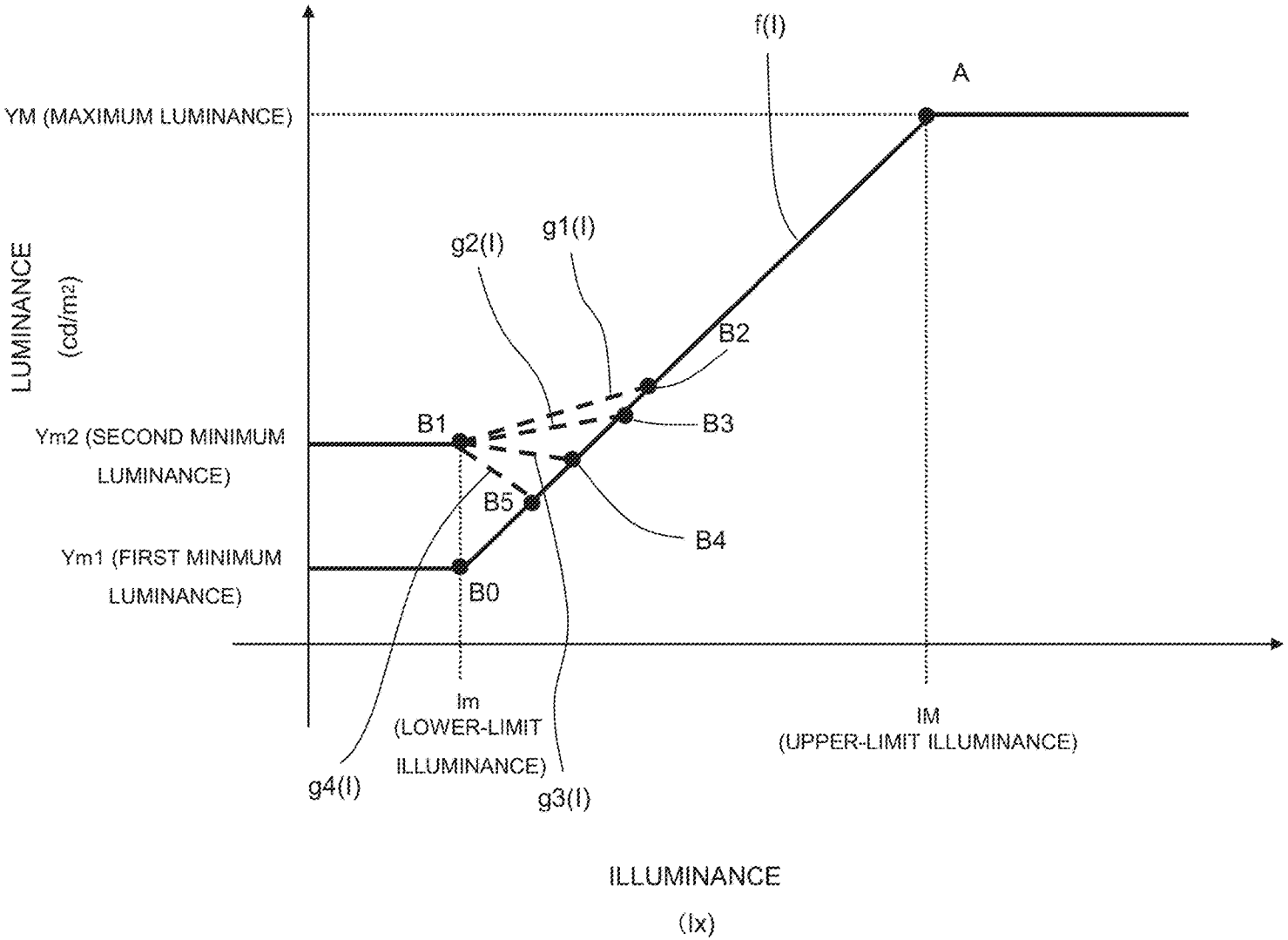

Fig. 5 MODIFICATION 2
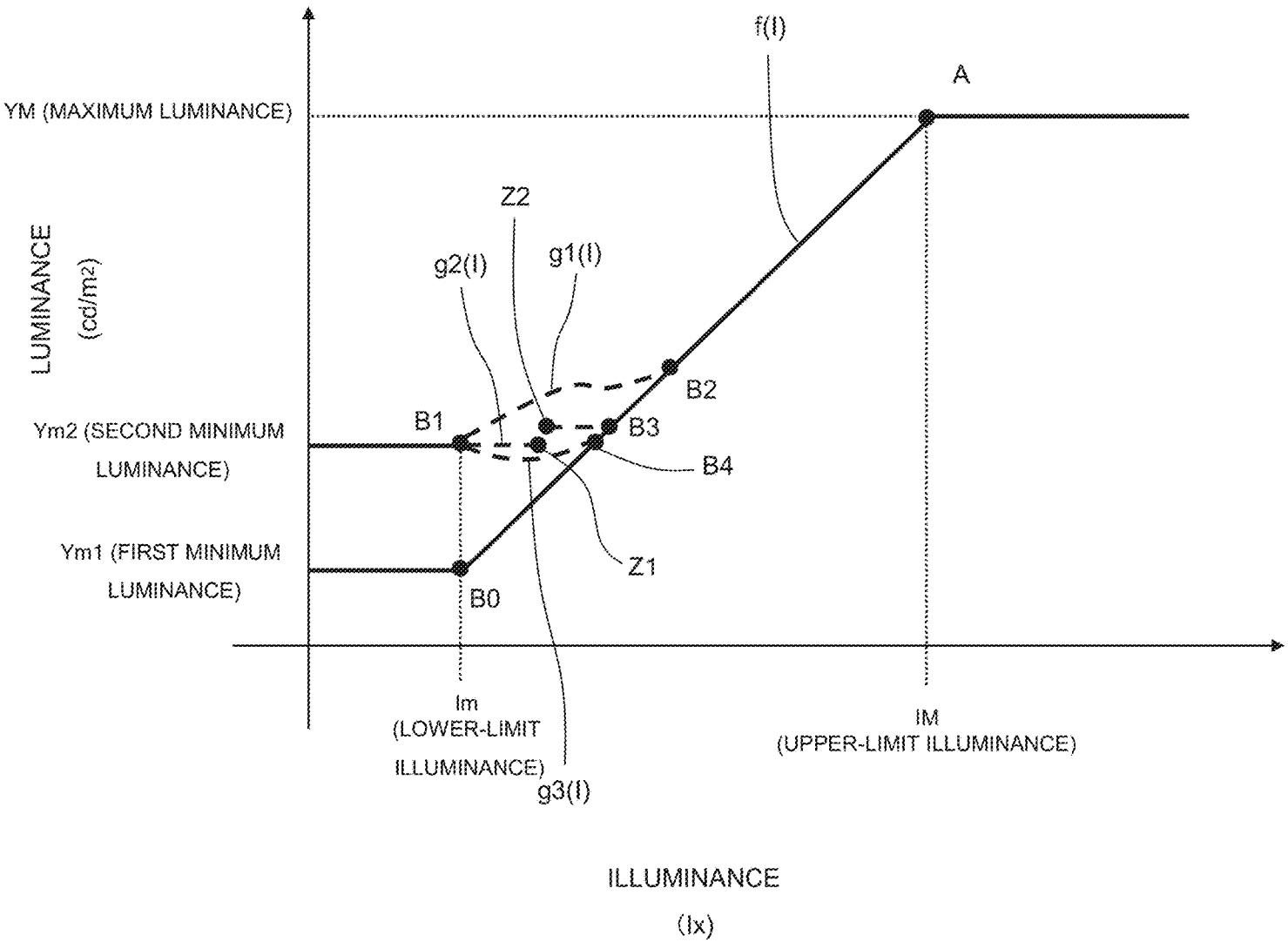

Fig. 6 MODIFICATION 3
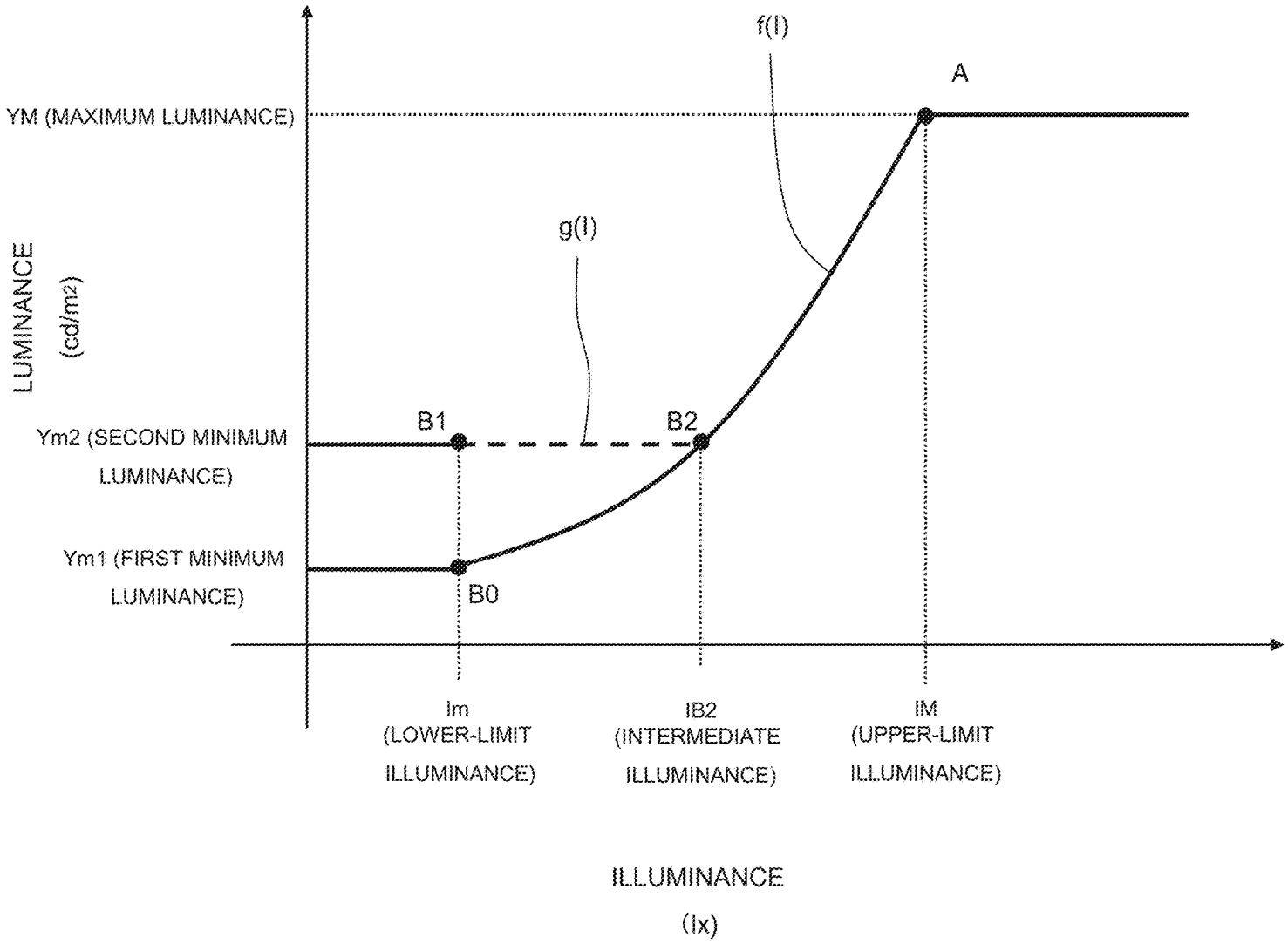

| | g (l) = 25 | | f (l) = 0.5 * l | | | | | |
|---|---|---|---|---|---|---|---|---|
| LUMINANCE ($cd/m^2$) | 25 | 25 | 37.5 | 50 | 75 | 100 | ... | 300 |
| ILLUMINANCE (lx) | 0 | 50 | 75 | 100 | 150 | 200 | ... | 600 |

R1

Fig. 7A

| | g (l) = **50** | | | f (l) = 0.5 * l | | | | |
|---|---|---|---|---|---|---|---|---|
| LUMINANCE ($cd/m^2$) | **50** | **50** | **50** | 50 | 75 | 100 | ... | 300 |
| ILLUMINANCE (lx) | 0 | 50 | 75 | 100 | 150 | 200 | ... | 600 |

R2

R1

Fig. 7B

SECOND EMBODIMENT

Fig. 9 SECOND EMBODIMENT

Fig. 10 MODIFICATION 1

Fig. 11 MODIFICATION 2

MODIFICATION 2

DISPLAY DEVICE, PROGRAM, AND DISPLAY METHOD FOR CONTROLLING RELATIONSHIP BETWEEN AMBIENT ILLUMINANCE AND DISPLAY LUMINANCE

TECHNICAL FIELD

The present invention relates to a display device that is controlled on the basis of the relationship between illuminance and luminance, a program, and a display method.

BACKGROUND ART

When the user uses a display device, the eyestrain of the user may be promoted by light emitted from a display of the display device. For this reason, there have been proposed display devices that are able to reduce eyestrain by controlling the luminance of a display in accordance with ambient illuminance.

Patent Literature 1 discloses a display system that changes the luminance of a display on the basis of ambient light detected by an ambient light sensor.

CITATION LIST

Patent Literature

[Patent Literature 1] Japanese Unexamined Patent Application Publication (Translation of PCT Application) No. 2001-522058

SUMMARY OF THE INVENTION

Technical Problem

FIG. 1 is a graph showing the relationship between the display luminance and the ambient illuminance detected by an optical sensor. As shown in FIG. 1, the technology disclosed in Patent Literature 1 stores the relationship between the ambient illuminance and the display luminance in advance and controls the display luminance in accordance with the ambient illuminance. The display luminance is fixed to the minimum value Y1 in a range in which the ambient illuminance is equal to or smaller than y1. The reason is considered to be that when the display luminance is further reduced, the user feels difficulty in visually recognizing the display. On the other hand, the display luminance is fixed to the maximum value in a range in which the ambient light is equal to or greater than y2. The reason is considered to be that the maximum value is the maximum luminance at which the display can emit light.

If the minimum luminance of the display when the ambient illuminance is y1 is changed to Y2, the technology disclosed in Patent Literature 1 connects a point B1 and a point A1 linearly. Thus, the relationship between the ambient illuminance and the display luminance from a point A to a point B is changed to the relationship between the ambient illuminance and the display luminance from the point A1 to the point B1. Even if the point B1 and point A are linearly connected, a similar result occurs. As seen above, the previously defined relationship (the relationship between the ambient illuminance and the display luminance from the point A to the point B) is changed. As a result, the user may feel that the appearance of the display has unexpectedly changed.

The present invention has been made in view of the foregoing, and an object thereof is to provide a display device, program, and display method that even if the luminance is changed with respect to the previously set relationship between the ambient-light illuminance, which is the illuminance of ambient light, and the luminance of a display, are able to suppress a change in the previous relationship.

Solution to Problem

A first aspect of the present invention provides a display device including a display, an illuminance acquisition unit configured to acquire an ambient-light illuminance that is an illuminance of ambient light, a relationship acquisition unit configured to acquire a relationship between the ambient-light illuminance and a luminance of the display, and a controller configured to control the relationship. The relationship is controlled by the controller so that the relationship satisfies conditions including (1) in a range in which the ambient-light illuminance is equal to or greater than a particular illuminance Is, the relationship matches a first relationship R1 passing through a first set point and a reference point that is the origin point or a point in a vicinity thereof, (2) when the ambient-light illuminance is the particular illuminance Is, a point on the first relationship R1 is defined as a particular point S, and (3) in a range in which the ambient-light illuminance is smaller than the particular illuminance Is, the relationship is a second relationship R2 passing through a second set point and the particular point S.

According to the first aspect of the present invention, the relationship between the illuminance and the luminance is controlled using the mutually different first relationship R1 and second relationship R2 having the particular point S as a boundary. Thus, even if the second relationship R2 is changed, a change in the first relationship R1 can be suppressed.

A second aspect of the present invention provides a display device including a display, an illuminance acquisition unit configured to acquire an ambient-light illuminance that is an illuminance of ambient light, and a relationship acquisition unit configured to acquire a relationship between the ambient-light illuminance and a luminance of the display. The relationship is set such that the luminance becomes a minimum luminance Ym when the ambient-light illuminance is smaller than a predetermined lower-limit illuminance Im, and the luminance becomes a maximum luminance YM when the ambient-light illuminance exceeds a predetermined upper-limit illuminance IM. When the minimum luminance Ym is changed from a first minimum luminance Ym1 to a second minimum luminance Ym2 greater than the first minimum luminance Ym1, the relationship is controlled so that the relationship satisfies conditions including (1) when the minimum luminance Ym is the first minimum luminance Ym1, a relationship between the illuminance and the luminance in a range between the lower-limit illuminance Im and the upper-limit illuminance IM is defined as a first relationship R1, (2) in a range in which the ambient-light illuminance exceeds a predetermined intermediate illuminance, the first relationship R1 is not changed, (3) the intermediate illuminance is an illuminance between the lower-limit illuminance Im and the upper-limit illuminance IM, (4) the first relationship R1 is changed to a second relationship R2 in a range between the lower-limit illuminance Im and the intermediate illuminance, and (5) the second relationship R2 is generated such that a luminance specified by the second relationship R2 falls within a predetermined luminance range from the second minimum luminance Ym2 regardless of a value of the second minimum luminance Ym2.

According to the second aspect of the present invention, when the minimum luminance Ym is changed from the first minimum luminance Ym1 to the second minimum luminance Ym2, the relationship is changed so that the relationship satisfies conditions including:

(1) when the minimum luminance Ym is the first minimum luminance Ym1, the relationship between the illuminance and the luminance in the range between the lower-limit illuminance Im and the upper-limit illuminance IM is defined as the first relationship R1;

(2) in the range in which the acquired illuminance exceeds the predetermined intermediate illuminance, the first relationship R1 is not changed;

(3) the intermediate illuminance is an illuminance between the lower-limit illuminance Im and the upper-limit illuminance IM;

(4) the first relationship R1 is changed to the second relationship R2 in the range between the lower-limit illuminance Im and the intermediate illuminance; and (5) the second relationship R2 is generated such that a luminance specified by the second relationship R2 falls within the predetermined luminance range from the second minimum luminance Ym2 regardless of the value of the second minimum luminance Ym2.

Thus, the display characteristics of the display are maintained in the range in which the illuminance exceeds the intermediate illuminance, allowing for suppression of an unexpected change in appearance.

Various embodiments of the present invention are described below. The embodiments below can be combined with each other.

<First Aspect>

Preferably, an inclination of the first relationship R1 passing through the first set point and the particular point S is set so as to be greater than an inclination of the second relationship R2 passing through the second set point and the particular point S.

Preferably, when the second set point is changed, the relationship is controlled so that the relationship satisfies conditions including (4) in a range in which the ambient light illuminance is equal to or greater than the particular illuminance Is, the first relationship R1 is not changed and (5) the second relationship R2 is changed so as to pass through the changed second set point and the particular point S.

Preferably, when the second set point is changed and a luminance of the particular point S falls below a luminance of the changed second set point, the relationship is controlled so that the relationship satisfies conditions including (6) a point on the first relationship R1 having the same luminance as the luminance of the changed second set point is set as a third set point, (7) in a range in which the ambient light illuminance is equal to or greater than an illuminance of the third set point P3, the relationship matches the first relationship R1, and (8) in a range in which the ambient light illuminance is equal to or smaller than the illuminance of the third set point P3, the relationship becomes the same luminance as a luminance of the third set point.

Preferably, when the first set point is changed and a luminance of the changed first set point falls below a luminance of the second set point, the relationship is controlled so that the relationship satisfies conditions including (9) in a range in which the ambient-light illuminance is equal to or greater than an illuminance of the changed first set point, the relationship matches a third relationship R3 passing through the changed first set point and the origin point or the reference point and (10) in a range in which the ambient-light illuminance is equal to or smaller than the illuminance of the changed first set point, the relationship becomes the same luminance as the luminance of the changed first set point.

Preferably, the particular illuminance is an illuminance determined on the basis of a sensory evaluation and is an illuminance at which a test subject feels that the display is dark while the ambient-light illuminance is reduced with liner characteristics.

<Second Aspect>

Preferably, the second relationship R2 is set such that the luminance in a range between the lower-limit illuminance Im and the intermediate illuminance does not exceed a luminance at the intermediate illuminance.

Preferably, the second relationship R2 is set such that the luminance does not decrease with an increase in the illuminance in a range between the lower-limit illuminance Im and the intermediate illuminance.

Preferably, the second relationship R2 is set such that the luminance in a range between the lower-limit illuminance Im and the intermediate illuminance becomes the second minimum luminance Ym2.

Preferably, the first relationship R1 is a monotone non-decrease function.

Preferably, the display device further includes a luminance controller configured to control the luminance of the display on the basis of the ambient-light illuminance and the first relationship R1 or the second relationship R2.

BRIEF DESCRIPTION OF DRAWINGS

FIG. 3 is a graph showing the relationship between illuminance and luminance according to the first embodiment of the present invention.

FIG. 4 is a graph showing the relationship between illuminance and luminance according to a modification 1 of the first embodiment.

FIG. 5 is a graph showing the relationship between illuminance and luminance according to a modification 2 of the first embodiment.

FIG. 6 is a graph showing the relationship between illuminance and luminance according to a modification 3 of the first embodiment.

FIG. 7A is a diagram showing a yet-to-be-changed relationship table, and FIG. 7B is a diagram showing a changed relationship table.

DESCRIPTION OF EMBODIMENTS

Figure 1:
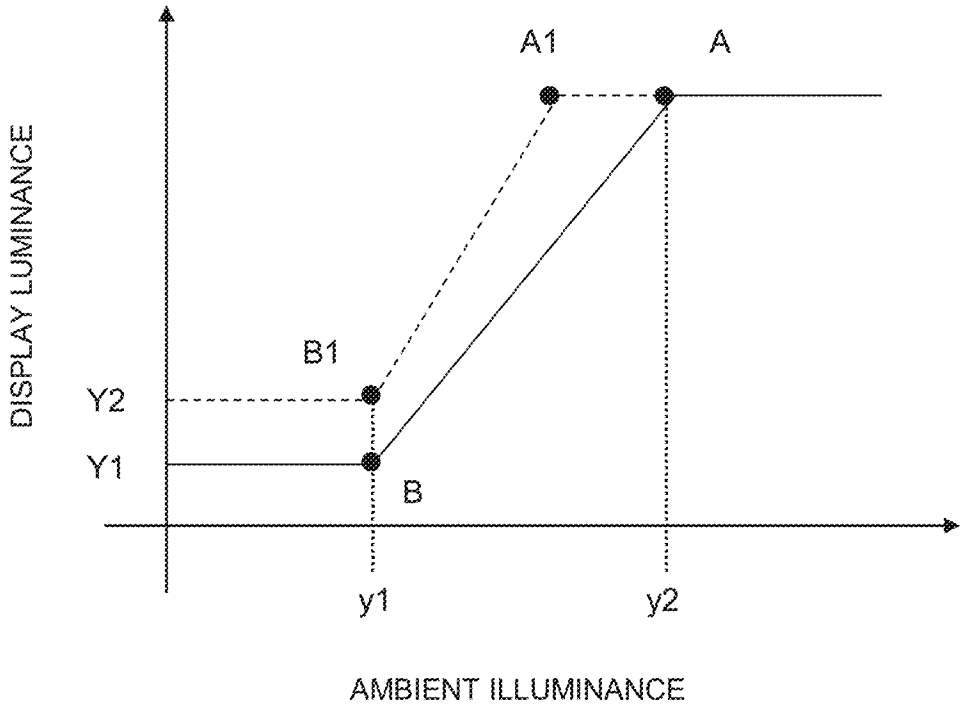
FIG. 1 is a diagram showing related art.
Figure 2:
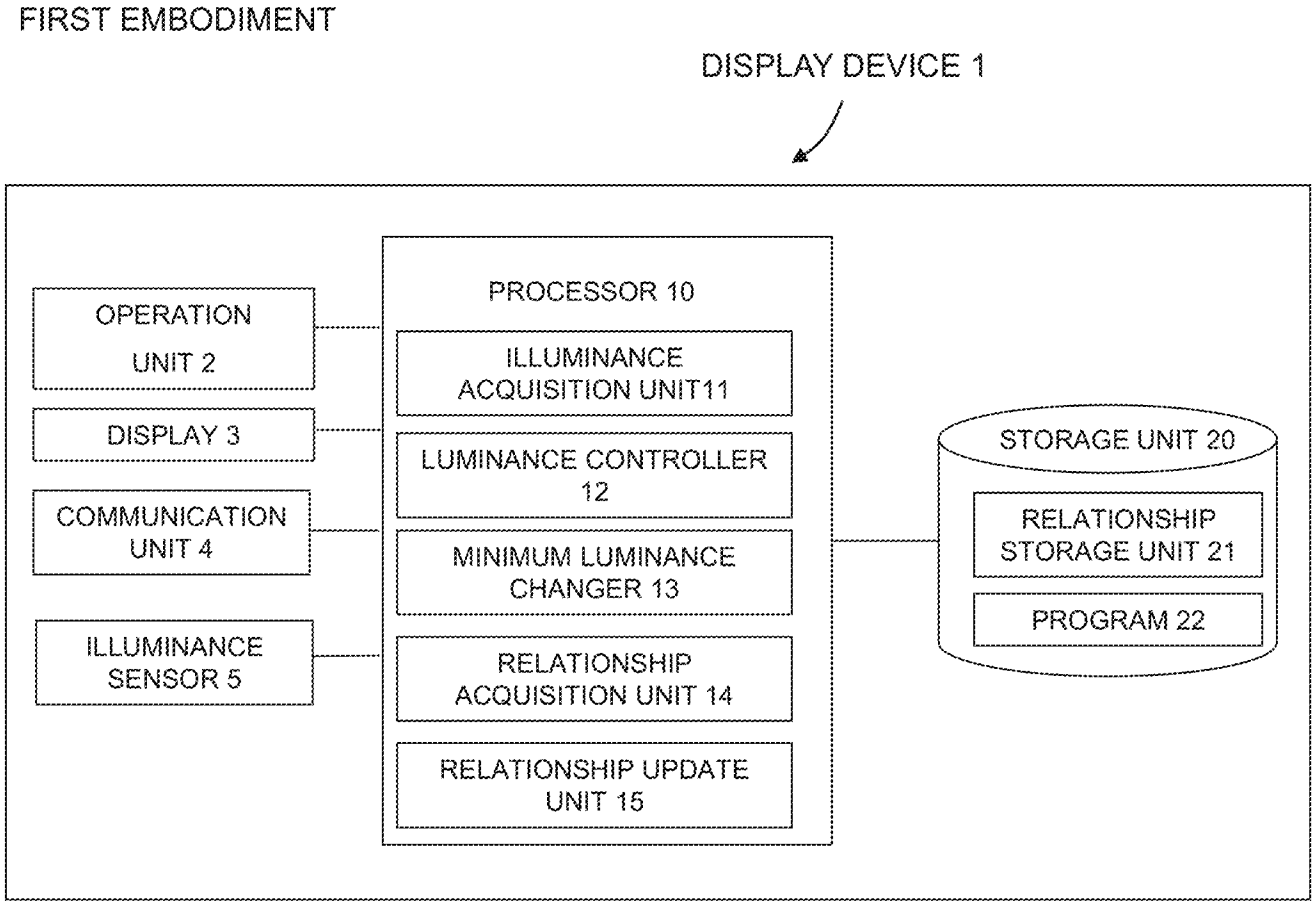
FIG. 2 is a function block diagram of a display device 1 according to a first embodiment of the present invention.

Now, embodiments of the present invention will be described with reference to the drawings. Various features described in the embodiments below can be combined with each other.

First Embodiment

A display device 1 according to a first embodiment of the present invention will be described with reference to FIGS. 2 to 6. The first embodiment relates to the second aspect, and a second embodiment relates to the first aspect.

<Display Device 1>

The display device 1 includes an operation unit 2, a display 3, a communication unit 4, an illuminance sensor 5, a processor 10, and a storage unit 20. The operation unit 2 is, for example, a touchscreen, keyboard, voice input unit, or motion detector and is used to operate the display 3. The display 3 is, for example, a liquid crystal display, organic EL display, touchscreen display, or any other type of display and displays various types of images (including still and moving images). The communication unit 4 is any type of I/O and transmits and receives various types of data to and from the processor 10 or other information processing devices. The illuminance sensor 5 measures the illuminance of ambient light around the place in which the display device 1 is placed.

The processor 10 includes an illuminance acquisition unit 11, a luminance controller 12, a minimum luminance changer 13, a relationship acquisition unit 14, and a relationship update unit 15. The storage unit 20 includes a relationship storage unit 21 and a program 22. The processor 10 is, for example, a CPU or the like and reads the program 22 and performs various types of arithmetic processing. The storage unit 20 is, for example, a memory, HDD, SSD, or the like and stores various types of data or programs. In the present embodiment, the storage unit 20 is a non-volatile memory.

The illuminance acquisition unit 11 acquires the ambient-light illuminance, which is the illuminance of ambient light measured by the illuminance sensor 5. The luminance controller 12 controls the luminance of the display 3 in accordance with the ambient-light illuminance acquired by the illuminance acquisition unit 11 and a first relationship R1 or a second relationship R2 between the illuminance and the luminance stored in the relationship storage unit 21. As used herein, the term "the luminance of the display 3" refers to a luminance observed from the outside with respect to a particular luminance set value (e.g., the luminance set value of the $255^{th}$ gradation (the luminance set value of the highest gradation) among the luminance set values set for the 255 gradations). This control is performed using any technique, for example, by controlling the amount of light of a backlight (not shown). The minimum luminance changer 13 changes a minimum luminance Ym corresponding to a predetermined lower-limit illuminance Im with respect to the first relationship R1 between the illuminance and the luminance stored in the relationship storage unit 21. This change is performed, for example, when the user operates the operation unit 2. The relationship acquisition unit 14 acquires the first relationship R1 between the illuminance and the luminance stored in the relationship storage unit 21. When the minimum luminance Ym is changed, the relationship update unit 15 does not change the first relationship R1 in a range exceeding a predetermined intermediate illuminance and changes the first relationship R1 to the second relationship R2 in a range between the lower-limit illuminance Im and the intermediate illuminance. Details of this change will be described later with reference to FIG. 3.

The relationship storage unit 21 stores the first relationship R1 between the illuminance and the luminance (f(I) in FIG. 3) or the second relationship R2 between the illuminance and the luminance (g(I) in FIG. 3). These relationships are set such that the relationships satisfy the following conditions:

- when the illuminance is smaller than the lower-limit illuminance Im, the luminance becomes the minimum luminance Ym;
- when the illuminance exceeds an upper-limit illuminance IM, the luminance becomes a maximum luminance YM;
- when the minimum luminance Ym is a first minimum luminance Ym1, the relationship between the illuminance and the luminance in the range between the lower-limit illuminance Im and the upper-limit illuminance IM is defined as the first relationship R1;
- when the minimum luminance Ym is changed from the first minimum luminance Ym1 to a second minimum luminance Ym2 greater than the first minimum luminance, the relationship between the illuminance and the luminance remains the first relationship R1 in the range between the intermediate illuminance and the upper-limit illuminance IM, and the relationship between the illuminance and the luminance is the second relationship R2 different from the first relationship R1 in the range between the lower-limit illuminance Im and the intermediate illuminance;
- the intermediate illuminance is an illuminance between the lower-limit illuminance Im and the upper-limit illuminance IM; and
- the second relationship R2 is generated such that a luminance specified by the second relationship R2 falls within a predetermined luminance range from the second minimum luminance Ym2 regardless of the value of the second minimum luminance Ym2.

The program 22 causes the processor 10 to perform various types of processing.

These elements may be implemented by software or hardware. In the case of software, the elements may be implemented when the processor 10 executes the program 22. The program 22 may be stored in the built-in storage unit 20 or a computer-readable non-transitory storage medium. The program 22 may also be previously stored in an external storage, then read, and executed by so-called cloud computing. In the case of hardware, the elements may be implemented by any type of circuit, such as ASIC, FPGA, or DRP.

<Method for Controlling Minimum Luminance Ym>

Next, referring to FIG. 3, a method for controlling the minimum luminance Ym will be described. FIG. 3 is a graph showing the relationship between the illuminance and the luminance according to the first embodiment of the present invention. In the first embodiment, as shown by a point B0 in FIG. 3, the relationship is set such that when the ambient-light illuminance is the predetermined lower-limit illuminance Im (e.g., 50 lx), the luminance of the display 3 becomes the predetermined first minimum luminance Ym1 (e.g., 25 cd/$m^2$). Also, as shown by a point A, the relationship is set such that when the ambient-light illuminance is the predetermined upper-limit illuminance IM (e.g., 600 lx), the luminance of the display 3 becomes the predetermined maximum luminance YM (e.g., 300 cd/$m^2$). The first relationship R1 is set such that the point A and point B0 form a line when the illuminance is in the range from Im to IM, and is represented by "luminance=f(I)=0.5×I [cd/m$^2$] (Im<I<IM)." That is, in the first embodiment, the first relationship R1 is a monotone increasing function (or a monotone non-decreasing function).

In the first embodiment, when the ambient-light illuminance is smaller than the lower-limit illuminance Im, the minimum luminance Ym is a constant value. The reason is that if the luminance of the display 3 is reduced when the ambient-light illuminance is smaller than the lower-limit illuminance Im, the user feels difficulty in visually recognizing the display 3 and therefore the display 3 needs to emit light at a certain level of luminance. Also, when the ambient-light illuminance exceeds the upper-limit illuminance IM, the maximum luminance YM is a constant value. This constant value is the maximum luminance at which the display 3 can emit light, or a preset luminance. Also, the first relationship R1 between the illuminance and the luminance in the range between the point A and point B0 is a linear function. This aims to, when the user is seeing the surroundings (e.g., wall), bring a change in the illuminance of ambient light and a change in the luminance of the surroundings close to each other. Thus, it is possible to bring, close to each other, a change in the size of the pupil due to a change in the illuminance of ambient light when the user is seeing the surroundings and a change in the size of the pupil due to a change in the illuminance of ambient light when the user is seeing the display 3. In particular, the first relationship R1 is preferably a function passing through a reference point CP provided at the origin point or its vicinity (e.g., in a range specified by an illuminance of 0 to 10 [lx] and a luminance of 0 to 10 [cd/m$^2$]). Thus, the eyestrain of the user can be reduced.

Here, it is assumed that the user operates the operation unit 2 and thus the minimum luminance changer 13 changes the minimum luminance Ym from the first minimum luminance Ym1 to the second minimum luminance Ym2 (e.g., 50 cd/m$^2$). In the first embodiment, the second minimum luminance Ym2 is greater than the first minimum luminance Ym1. The first minimum luminance Ym1 is the minimum luminance that can be set in the display device 1. At this time, the relationship acquisition unit 14 acquires the first relationship R1 (=f(I)) shown in FIG. 3 from the relationship storage unit 21 and generates a new second relationship R2 (=g (I)) such that the luminance becomes the second minimum luminance Ym2 in a range from the point B1, which the intersection of the second minimum luminance Ym2 and the lower-limit illuminance Im, to the point B2, which is the intersection of an extension in the illuminance direction of the point B1 and f(I). In the first embodiment, the second relationship R2 is a constant of "g(I)=50 [cd/m$^2$]." Thus, a new correspondence between the illuminance and the luminance can be made without changing the first relationship R1 (=f(I)), which is the previous relationship, in a range exceeding an intermediate illuminance IB2 (1001×) corresponding to the point B2. That is, in this aspect, the intermediate illuminance IB2 corresponding to the point B2 corresponds to a predetermined intermediate illuminance. In the range between the lower-limit illuminance Im and the intermediate illuminance IB2, the first relationship R1 is changed to the second relationship R2 in which the luminance does not exceed the luminance corresponding to the intermediate illuminance IB2.

The method for generating the second relationship R2 is not limited to that described above. The second relationship R2 may be generated such that a luminance (a luminance in the range between the lower-limit illuminance Im and the intermediate illuminance) specified by the second relationship R2 falls within a predetermined luminance range from the second minimum luminance Ym2 regardless of the value of the second minimum luminance Ym2.

For example, assuming that the predetermined luminance range is D1 (20 cd/m$^2$), the second relationship R2 may be generated such that the point B1 and a point P1 (a point on f(I) having a luminance obtained by adding D1 to the second minimum luminance Ym2) are connected and the luminance is within a range of 30 cd/m$^2$ to 70 cd/m$^2$ in a range between the lower-limit illuminance Im and an illuminance IP1 corresponding to the point P1. In this case, the illuminance IP1 corresponds to the predetermined intermediate illuminance. The second relationship R2 (=g(I)) may have any shape and, for example, may be a linear function, a quadratic function, a monotone non-decreasing function, a monotone increasing function, a function that turns to a constant or turns to decrease at a certain point, or a discontinuous function.

The range in which the first relationship R1 is changed may be made narrower than that in the above example. For example, assuming that the predetermined luminance range is D2(10 cd/m$^2$), the second relationship R2 may be generated such that the point B1 and a point P2 (a point on f(I) having a luminance obtained by adding D2 to the second minimum luminance Ym2) are connected and the luminance is within a range of 40 cd/m$^2$ to 60 cd/m$^2$ in a range between the lower-limit illuminance Im and an illuminance IP2 corresponding to the point P2. In this case, the illuminance IP2 corresponds to the predetermined intermediate illuminance. As seen above, the value of the predetermined intermediate illuminance becomes smaller as the predetermined luminance range is made narrower, allowing the range in which the first relationship R1 is changed (the range from the lower-limit illuminance Im to the intermediate illuminance) to be made narrower.

The predetermined luminance range (D1, D2) may be determined using any method and may be any value in accordance with the environment. Also, the second relationship R2 may be generated such that the changed luminance is within a range from the second minimum luminance Ym2 to a greater luminance than the second minimum luminance Ym2 by D1 or D2. In this case, the second relationship R2 is preferably set such that the luminance does not decrease with increases in the illuminance in the range between the lower-limit illuminance Im and the intermediate illuminance.

The relationship update unit 15 stores the updated first relationship R1 and second relationship R2 in the relationship storage unit 21. Until a subsequent update is made, the luminance controller 12 controls the luminance of the display 3 on the basis of the illuminance, and the updated first relationship R1 and second relationship R2.

<Modification 1>

Next, a modification 1 of the first embodiment will be described with reference to FIG. 4. The same components are assigned the same reference numerals and will not be described.

FIG. 4 shows four new second relationships R2 (=g1(I) to g4(I)) generated between a point B1 and points B2 to B5. The second relationships R2 (g1(I) to g4(I)) are connected to a first relationship R1 (=f(I)) at the points B2 to B5, respectively. g1(I) and g2(I) are monotone increasing functions, and g3(I) and g4(I) are monotone decreasing functions. In the modification 1, illuminances corresponding to the points B2 to B5 correspond to predetermined intermediate illuminances. Here, the following conditions are satisfied:

(1) when a minimum luminance Ym is a first minimum luminance Ym1, the relationship between the illuminance and the luminance in a range between a lower-limit illuminance Im and an upper-limit illuminance IM is defined as a first relationship R1 (=f(I));

(2) the first relationship R1 is not changed in ranges in which the acquired illuminance exceeds predetermined intermediate illuminances (illuminances corresponding to the points B2 to B5);

(3) the intermediate illuminances (the illuminances corresponding to the points B2 to B5) are illuminances between the lower-limit illuminance Im and upper-limit illuminance IM;

(4) the first relationship R1 is changed to the second relationships R2 (=g1(I) to g4(I)) in a range between the lower-limit illuminance Im and the intermediate illuminances (the illuminances corresponding to the points B2 to B5); and (5) the second relationships R2 are generated such that luminances specified by the second relationships R2 fall within predetermined luminance ranges from the second minimum luminance Ym2 regardless of the value of the second minimum luminance Ym2.

<Modification 2>

Next, a modification 2 of the first embodiment will be described with reference to FIG. 5. FIG. 5 shows three new second relationships R2 (=g1(I) to g3(I)) generated between a point B1 and points B2 to B4. The second relationships R2 (g1(I) to g3(I)) are connected to a first relationship R1 (=f(I)) at the points B2 to B4, respectively. g1(I) and g3(I) are a combination of a monotone increasing function and a monotone decreasing function, and g2(I) has discontinuous constant values at a point Z1 and a point Z2. In the modification 2, illuminances corresponding to the points B2 to B4 correspond to predetermined intermediate illuminances. Here, the conditions (1) to (4) in the modification 1 are satisfied.

<Modification 3>

Next, a modification 3 of the first embodiment will be described with reference to FIG. 6. In FIG. 6, a first relationship R1 (=f(I)) between the illuminance and the luminance is represented by a quadratic function in a range between a lower-limit illuminance Im and an upper-limit illuminance IM. In this case also, a second relationship R2 (=g(I)) can be newly generated as in any aspect of the first embodiment. In the example in FIG. 6, a method for generating this function g(I) is similar to the method described with reference to FIG. 3. Instead of the downward protruding quadratic function shown in FIG. 6, an upward protruding quadratic function may be used.

Instead of these modifications, a function in which the luminance is a constant value in a predetermined illuminance range may be used as a first relationship R1 (=f(I)). Also, a function in which the luminance monotonously decreases in a predetermined illuminance range may be used as a first relationship R1 (=f(I)).

<Aspect in which Relationship Table is Used>

Next, an aspect in which a relationship table is used will be described with reference to FIGS. 7A and 7B. FIG. 7A is a diagram showing a yet-to-be-changed relationship table, and FIG. 7B is a diagram showing a changed relationship table. As shown in FIGS. 7A and 7B, a relationship table may be used in place of a function as shown in FIG. 3.

Specifically, the relationship table shown in FIG. 7A defines the relationship between the illuminance and the luminance. The relationship table shown in FIG. 7A corresponds to the function f(I) shown in FIG. 3.

As shown in FIG. 7A, the relationship is approximated by "g(I)=25[cd/m$^2$]" in a range in which the illuminance is equal to or smaller than 50 lx. The first relationship R1 is approximated by "f(I)=0.5×I[cd/m$^2$]" in a range in which the illuminance exceeds 50 lx. These approximations are obtained by linearly interpolating between the illuminances defined in the relationship table.

As shown in FIGS. 7A and 7B, when the minimum luminance changer 13 changes a luminance corresponding to an illuminance of 50 lx from 25 cd/m$^2$ to 50 cd/m$^2$, a luminance corresponding to an illuminance 0 lx is changed from 25 cd/m$^2$ to 50 cd/m$^2$, and a luminance corresponding to an illuminance 75 lx is changed from 37.5 cd/m$^2$ to 50 cd/m$^2$. Thus, as with the function g(I) shown in FIG. 3, the newly generated second relationship R2 is approximated by "g(I)=50[cd/m$^2$]" in a range in which the illuminance is equal to or smaller than 75 lx in the changed relationship table. Thus, in a range in which the illuminance is 50 lx to 75 lx, the luminance becomes a constant value. On the other hand, in a range in which the illuminance is 100 lx to 600 lx, which exceeds the illuminance 75 lx, the first relationship R1 is approximated by "f(I)=0.5×I[cd/m$^2$]", that is, the first relationship R1 is not changed between before and after the change in the minimum luminance.

According to the embodiment and modifications described above, when the minimum luminance Ym is changed, the first relationship R1 can be changed in a range between the lower-limit illuminance Im and the intermediate illuminance without changing the first relationship R1 in a range in which the illuminance exceeds the predetermined intermediate illuminance. Thus, the display characteristics of the display 3 are maintained in the range in which the illuminance exceeds the intermediate illuminance, allowing for suppression of an unexpected change in appearance.

<Others>

While the embodiment and modifications have been described, the display device 1 according to the first embodiment is not limited thereto.

For example, the intermediate illuminance can be set appropriately in accordance with the characteristics or settings of the display device 1. For example, the intermediate illuminance may be set considering the magnitude of the maximum luminance YM or the magnitude of the second minimum luminance Ym2.

There may be provided a program that causes a computer or the display device 1 to function as an illuminance acquisition unit configured to acquire an illuminance of ambient light and a relationship acquisition unit configured to acquire a relationship between the illuminance and a luminance of the display, wherein the relationship is set such that the luminance becomes a minimum luminance Ym when the acquired illuminance is smaller than a predetermined lower-limit illuminance Im, and the luminance becomes a maximum luminance YM when the acquired illuminance exceeds a predetermined upper-limit illuminance IM, and wherein when the minimum luminance Ym is changed from a first minimum luminance Ym1 to a second minimum luminance Ym2 greater than the first minimum luminance Ym1, the relationship is controlled so that the relationship satisfies the following conditions:

(1) when the minimum luminance Ym is the first minimum luminance Ym1, the relationship between the illuminance and the luminance in a range between the lower-limit illuminance Im and the upper-limit illuminance IM is defined as a first relationship R1;

(2) the first relationship R1 is not changed in a range in which the acquired illuminance exceeds a predetermined intermediate illuminance;

(3) the intermediate illuminance is an illuminance between the lower-limit illuminance Im and the upper-limit illuminance IM;

(4) the first relationship R1 is changed to a second relationship R2 in a range between the lower-limit illuminance Im and the intermediate illuminance; and (5) the second relationship R2 is generated such that a luminance specified by the second relationship R2 falls within a predetermined luminance range from the second minimum luminance Ym2 regardless of the value of the second minimum luminance Ym2.

There may also be provided a computer-readable non-transitory storage medium having the functions of this program implemented thereon. This program may be distributed through the Internet or the like. The elements of the display device 1 may be contained in the same case or disposed in multiple cases in a distributed manner.

The following method also can realize the invention according to the first embodiment.

That is, a display method includes a display step of displaying, by a display, an image, an illuminance acquisition step of acquiring, by an illuminance acquisition unit, an ambient-light illuminance that is an illuminance of ambient light, and a relationship acquisition step of acquiring, by a relationship acquisition unit, a relationship between the ambient-light illuminance and a luminance of the display. The relationship is set such that the luminance becomes a minimum luminance Ym when the acquired illuminance is smaller than a predetermined lower-limit illuminance Im, and the luminance becomes a maximum luminance YM when the acquired illuminance exceeds a predetermined upper-limit illuminance IM. When the minimum luminance Ym is changed from a first minimum luminance Ym1 to a second minimum luminance Ym2 greater than the first minimum luminance Ym1, the relationship is controlled so that the relationship satisfies the following conditions:

(1) when the minimum luminance Ym is the first minimum luminance Ym1, a relationship between the illuminance and the luminance in a range between the lower-limit illuminance Im and the upper-limit illuminance IM is defined as a first relationship R1;

(2) in a range in which the acquired illuminance exceeds a predetermined intermediate illuminance, the first relationship R1 is not changed;

(3) the intermediate illuminance is an illuminance between the lower-limit illuminance Im and the upper-limit illuminance IM;

(4) the first relationship R1 is changed to a second relationship R2 in a range between the lower-limit illuminance Im and the intermediate illuminance; and (5) the second relationship R2 is generated such that a luminance specified by the second relationship R2 falls within a predetermined luminance range from the second minimum luminance Ym2 regardless of a value of the second minimum luminance Ym2.

Second Embodiment

Figure 8:
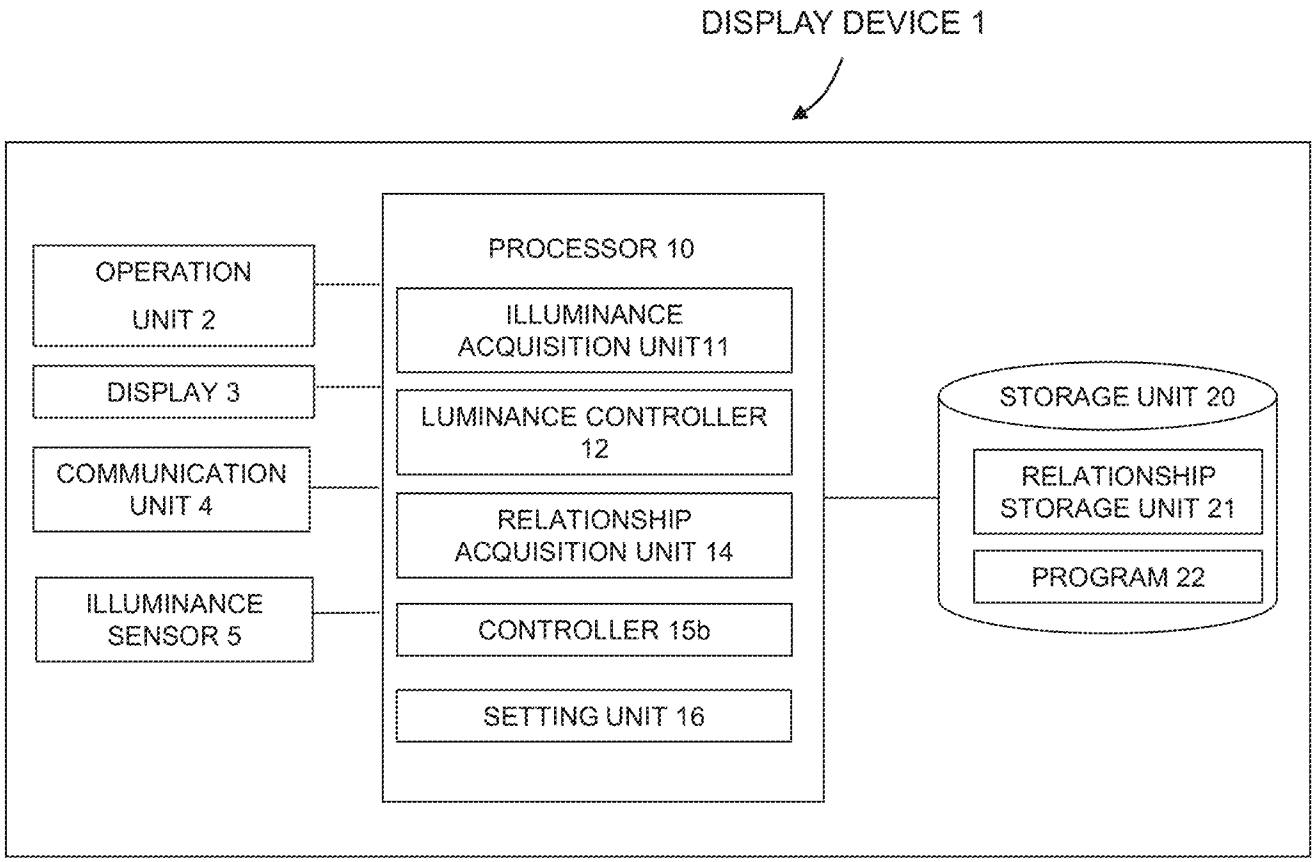
FIG. 8 is a function block diagram of a display device 1 according to a second embodiment of the present invention.

Next, a display device 1 according to a second embodiment of the present invention will be described with reference to FIGS. 8 to 12. As shown in FIG. 8, the display device 1 according to the second embodiment does not need the minimum luminance changer 13 of the display device 1 according to the first embodiment and includes a controller 15*b* and a setting unit 16 in place of the relationship update unit 15. The controller 15*b* controls the relationship between the ambient-light illuminance and the luminance. The setting unit 16 sets a first set point P1 and a second set point P2 (to be discussed later). The same elements as those in the first embodiment will not be described.

Figure 9:
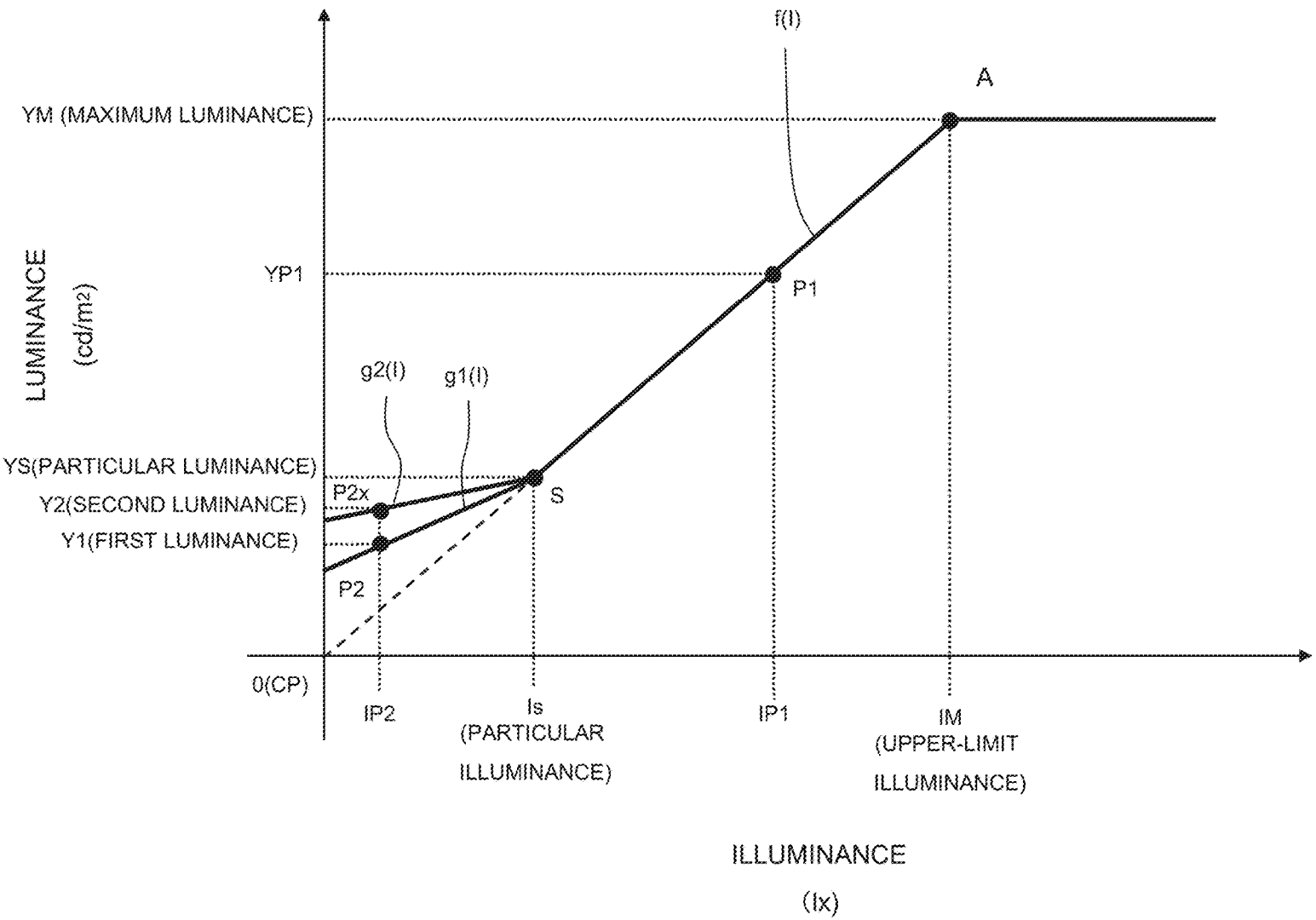
FIG. 9 is a graph showing the relationship between illuminance and luminance according to the second embodiment of the present invention.

As shown in FIG. 9, the second embodiment differs from the first embodiment in that the minimum luminance is not set. The relationship between the ambient-light illuminance and the luminance is controlled by the controller 15*b* such that the relationship satisfies the following conditions:

(1) in a range in which the ambient-light illuminance is equal to or greater than a particular illuminance Is, the relationship between the ambient-light illuminance and the luminance matches a first relationship R1 passing through the first set point and a reference point, which is the origin point or a point in its vicinity;

(2) when the ambient-light illuminance is the particular illuminance Is, a point on the first relationship R1 is defined as a particular point S; and (3) in a range in which the ambient-light illuminance is smaller than the particular illuminance Is, the relationship between the ambient-light illuminance and the luminance is a second relationship R2 passing through the second set point and the particular point S.

Details will be described below.

The particular illuminance Is is an illuminance determined on the basis of a sensory evaluation. Specifically, the particular illuminance Is is an illuminance at which the test subject feels that the display 3 is dark while the ambient-light illuminance is reduced with linear characteristics passing the reference point, which is the origin point or a point in its vicinity. The particular point S is a point on the first relationship R1 (=f(I)) when the ambient-light illuminance is the particular illuminance Is. The luminance of the particular point S is a particular luminance YS.

The first set point P1 is a point specified by a luminance set at an illuminance equal to or greater than the particular illuminance Is and the illuminance. The second set point P2 is a point specified by a luminance set at an illuminance smaller than the particular illuminance Is and the illuminance. Specifically, each set point is a point that when the ambient-light illuminance is a predetermined illuminance, is specified by a luminance arbitrarily set by the user and the predetermined ambient-light illuminance. In the second embodiment, the illuminance and luminance of the first set point P1 are an illuminance IP1 and a luminance YP1, respectively. The illuminance and luminance of the second set position P2 are an illuminance IP2 and a first luminance Y1, respectively.

In the second embodiment, the first relationship R1 (=f(I)) is a function passing through the first set point and a reference point CP provided at the origin point or its vicinity (e.g., in a range specified by 0 to 10 [lx] and 0 to 10 [cd/m$^2$]). In an example in FIG. 9, the reference point CP is provided at the origin point, and the first relationship R1 is "luminance=f(I)=0.5×1 [cd/m$^2$] (0<I<IM)."

The relationship between the ambient-light illuminance and the luminance is changed with the particular illuminance Is as a boundary. Specifically, in a range in which the ambient-light illuminance is equal to or greater than the particular illuminance Is, this relationship matches the first relationship R1. On the other hand, in a range in which the ambient-light illuminance is smaller than the particular illuminance Is, this relationship is the second relationship R2 (=g1(I)) passing through the second set point P2 and the particular point S. The second relationship R2 may have any characteristics. In the second embodiment, the inclination of the first relationship R1 at the particular point S is preferably set so as to be greater than the inclination of the second relationship R2 at the particular point S. When the inclination of the first relationship R1 at the particular point S is set so as to be smaller than the inclination of the second relationship R2 at the particular point S and when the ambient-light illuminance makes a transition from high illuminance to low illuminance, the luminance is abruptly changed with the particular illuminance Is as a boundary, giving the user a feeling of strangeness. The second embodiment aims to prevent this situation.

In the second embodiment, when the second set position P2 is changed, the relationship between the ambient-light illuminance and the luminance is controlled by the controller 15*b* so that the relationship satisfies the following conditions:

(4) in a range in which the illuminance is equal to or greater than the particular illuminance Is, the first relationship R1 is not changed; and (5) the second relationship R2 is changed so as to pass through the changed second set point and the particular point S.

Specifically, it is assumed that the setting unit 16 changes the second set position P2 to a second set point P2*x*. The luminance of the second set point P2*x* is a second luminance Y2. At this time, in a range in which the illuminance is equal to or greater than the particular illuminance Is, the controller 15*b* does not change the first relationship R1. On the other hand, in a range in which the illuminance is equal to or smaller than the particular illuminance Is, the controller 15*b* changes the second relationship R2 (=g1(I)) to a second relationship R2 (=g2(I)) passing through the changed second set point P2*x* and the particular point S. As seen above, even if the second set position P2 is changed, the relationship between the ambient-light illuminance and the luminance is maintained in the range in which the illuminance is equal to or greater than the particular illuminance Is.

The relationship update unit 15 stores the updated first relationship R1 and second relationship R2 in the relationship storage unit 21. Until a next update is made, the luminance controller 12 controls the luminance of the display 3 on the basis of the illuminance and the updated first relationship R1 and second relationship R2.

<Modification 1>

Figure 10:
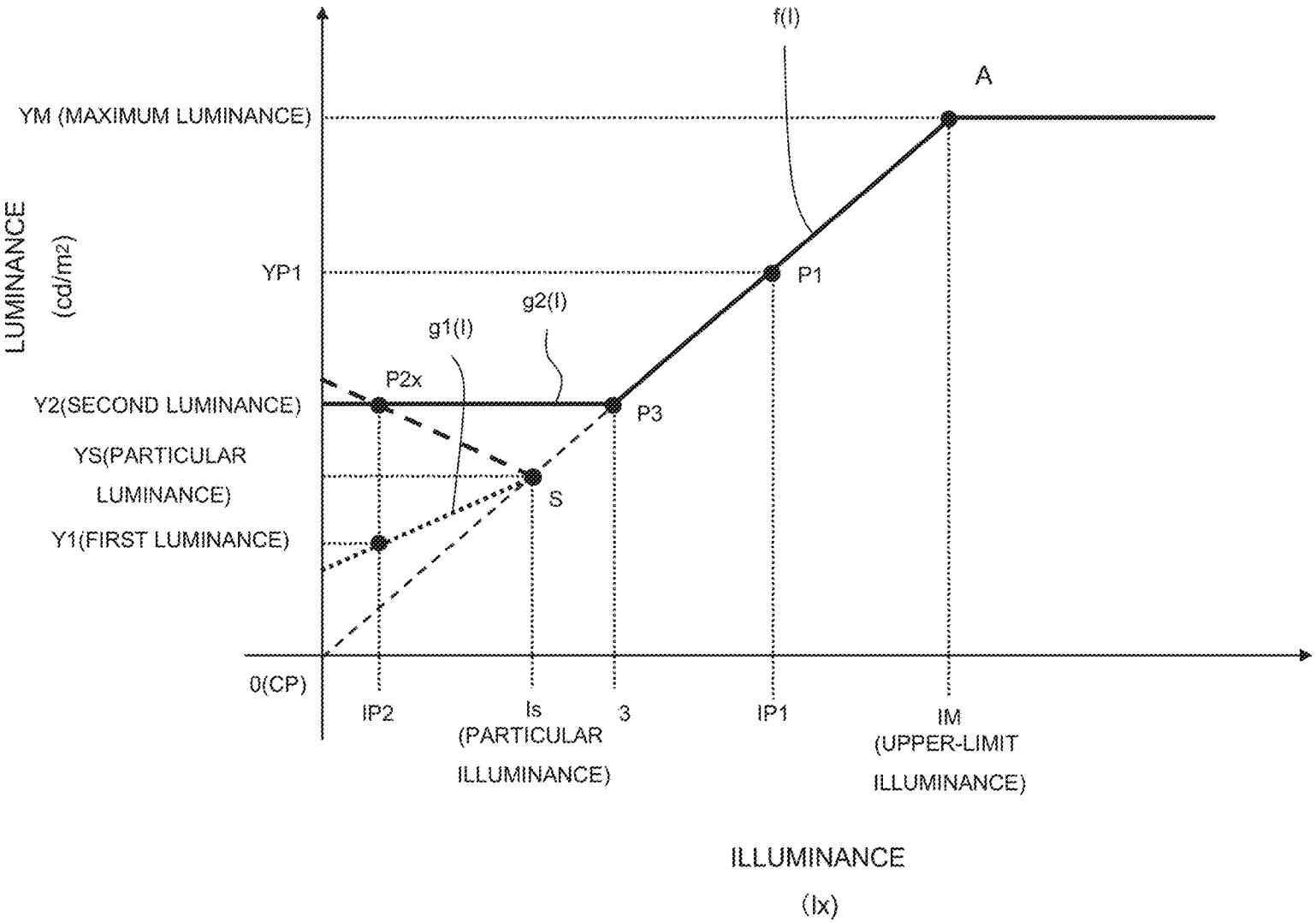
FIG. 10 is a graph showing the relationship between illuminance and luminance according to a modification 1 of the second embodiment.

Next, a modification 1 of the second embodiment will be described with reference to FIG. 10. The same components are assigned the same reference numerals and will not be described.

In the modification 1, when a second set position P2 is changed to a second set point P2*x* and a particular luminance YS of a particular point S falls below a second luminance Y2 of the changed second set point P2*x*, the relationship between the ambient-light illuminance and the luminance is controlled by a controller 15*b* so that the relationship satisfies the following conditions:

(6) a point on the first relationship R1 (=f(I)) having the same luminance as the second luminance Y2 of the changed second set point P2*x* is set as a third set point P3;

(7) in a range in which the illuminance is equal to or greater than an illuminance IP3 of the third set point P3, the relationship between the ambient-light illuminance and the luminance matches a first relationship R1; and (8) in a range in which the illuminance is equal to or smaller than the illuminance IP3 of the third set point P3, the relationship between the ambient-light illuminance and the luminance becomes the same luminance (=g2(I)) as the second luminance Y2 of the third set point P3.

When the second relationship R2 is changed so as to pass through the changed second set point P2*x* and the particular point S, in accordance with the control in the second embodiment (as shown by a broken line in FIG. 10) and when the luminance makes a transition from high illuminance to low illuminance, the luminance that has decreased increases with the particular illuminance Is as a boundary. Consequently, the user expecting that the luminance also decreases as the illuminance decreases is given a feeling of strangeness. The modification 1 aims to prevent this situation.

<Modification 2>

Figure 11:
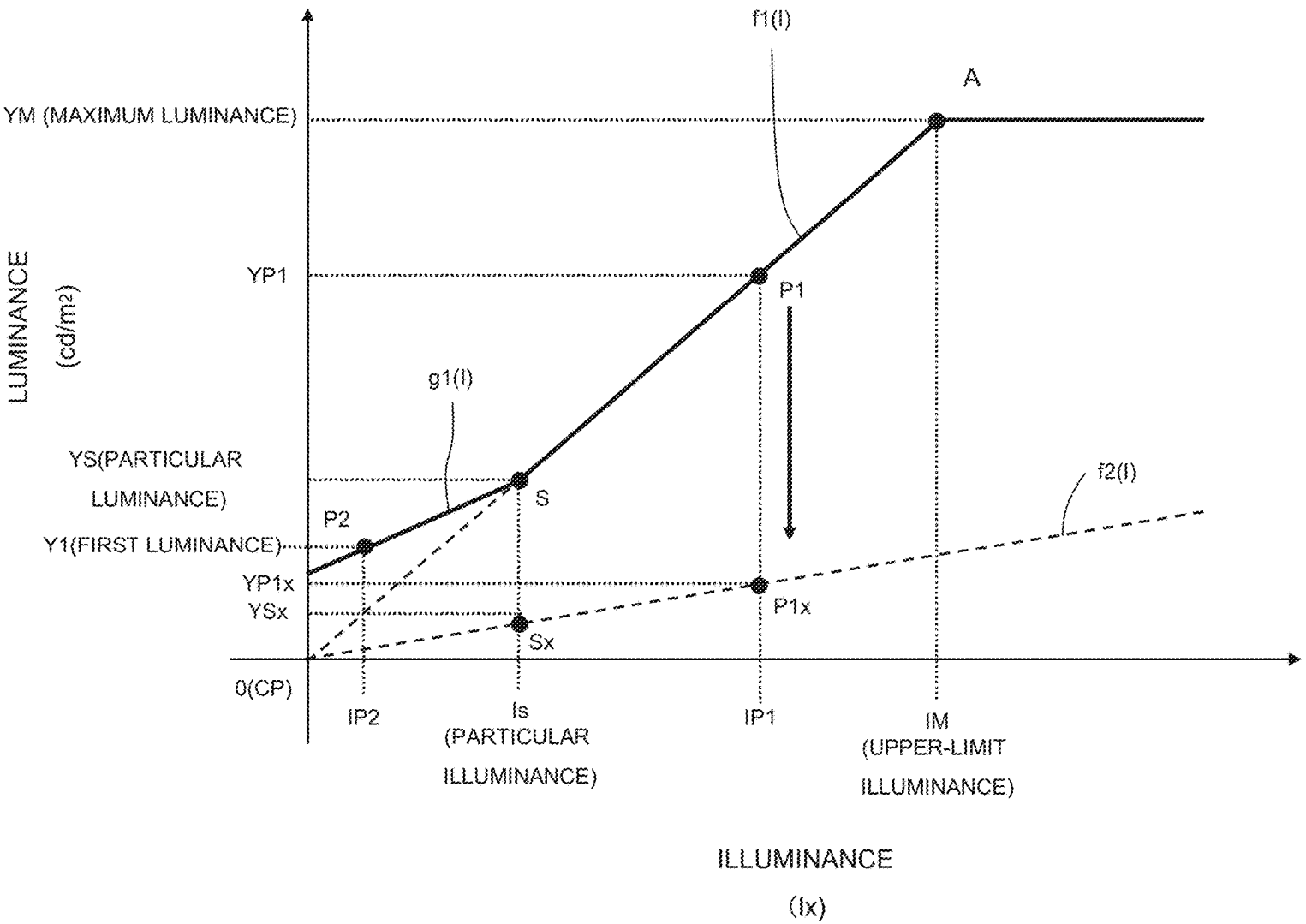
FIG. 11 is a graph showing the relationship between illuminance and luminance according to a modification 2 of the second embodiment.
Figure 12:
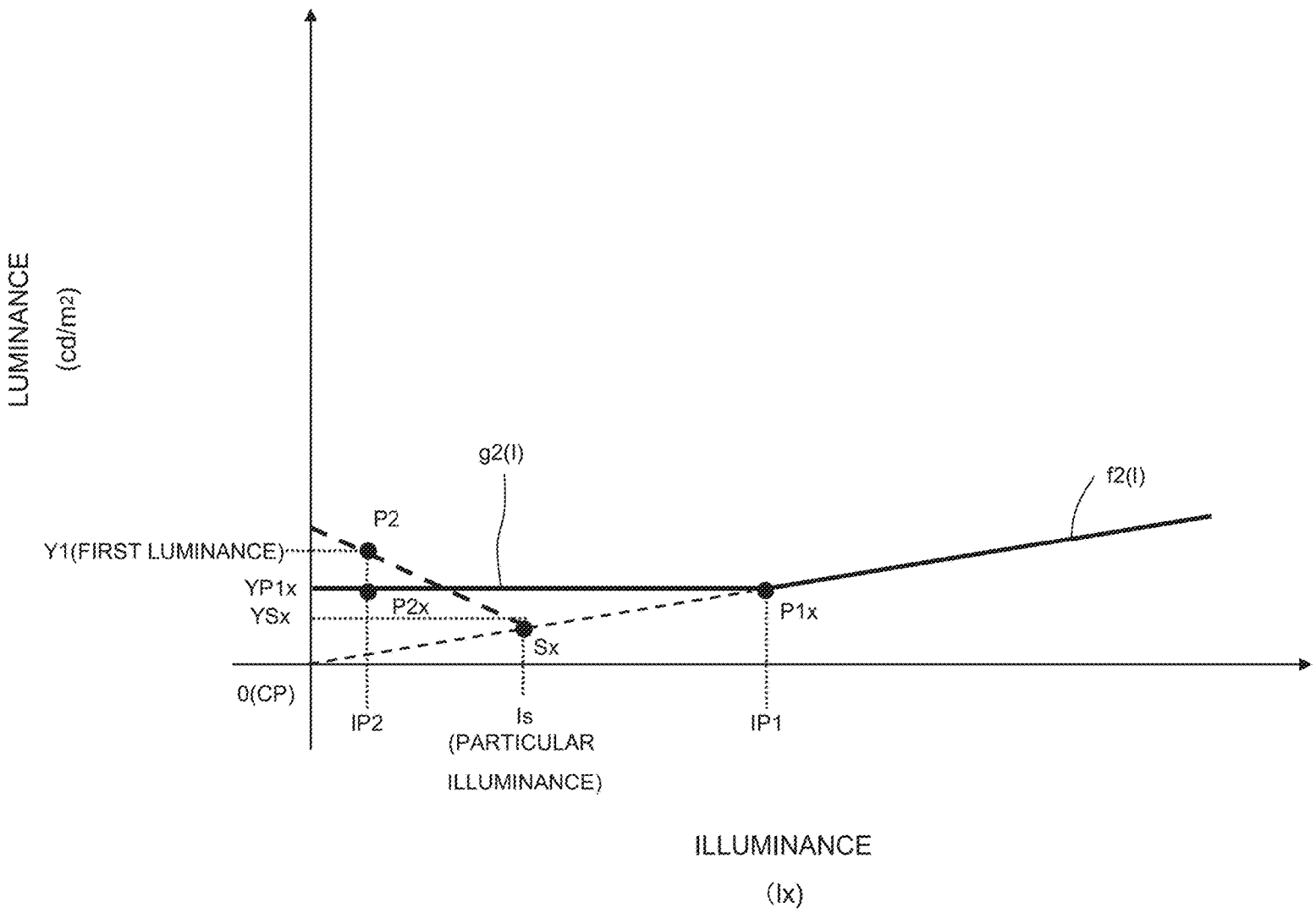
FIG. 12 is a graph showing the relationship between illuminance and luminance according to the modification 2 of the second embodiment.

Next, a modification 2 of the second embodiment will be described with reference to FIGS. 11 and 12.

In the modification 2, when a first set point P1 is changed to a first set point P1*x* and a luminance YP1*x* of the changed first set point P1*x* falls below a first luminance Y1 of a second set position P2, the relationship between the ambient-light illuminance and the luminance is controlled by a controller 15*b* so that the relationship satisfies the following conditions:

(9) in a range in which the illuminance is equal to or greater than an illuminance IP1 of the changed first set point P1*x*, the relationship between the ambient-light illuminance and the luminance matches a third relationship R3 (=f2(I)) passing through the changed first set point P1*x* and the origin point or a reference point CP; and

(10) in a range in which the illuminance is equal to or smaller than the illuminance IP1 of the changed first set point P1*x*, the relationship between the ambient-light illuminance and the luminance becomes the same luminance as the luminance YP1*x* of the changed first set point P1*x*.

Due to the above condition (10), a particular point S is changed to a particular point Sx (the illuminance and luminance thereof are a particular illuminance Is and a luminance YSx, respectively).

When a second relationship R2 is changed so as to pass through a second set position P2 and the changed particular point Sx, in accordance with the control in the second embodiment (as shown by a broken line in FIG. 12) and when the ambient-light illuminance makes a transition from high illuminance to low illuminance, the luminance that has decreased increases with the particular illuminance Is as a boundary. Consequently, the user expecting that the luminance also decreases as the illuminance decreases is given a feeling of strangeness. The modification 2 aims to prevent this situation.

<Others>

While the embodiment and modifications have been described, the display device 1 according to the second embodiment is not limited thereto.

For example, a reference point CP may be set at a point specified by an illuminance of 5 [lx] and a luminance 5 of [cd/m$^2$], and a function passing through the reference point CP and a first set point P1 may be defined as a first relationship R1.

As in the first embodiment, the first relationship R1 and second relationship R2 may have any shapes.

There may be provided a program that causes a computer or a display device 1 to function as a display, an illuminance acquisition unit configured to acquire an ambient-light illuminance that is an illuminance of ambient light, a relationship acquisition unit configured to acquire a relationship between the ambient-light illuminance and a luminance of the display, a controller configured to control the relationship, and a setting unit configured to set a first set point and a second set point, wherein the first set point is a point specified by a luminance set at an illuminance equal to or greater than a particular illuminance Is and the illuminance, the second set point is a point specified by a luminance set at an illuminance smaller than the particular illuminance Is and the illuminance, and the relationship is controlled by the controller so that the relationship satisfies the following conditions:

(1) in a range in which the ambient-light illuminance is equal to or greater than the particular illuminance Is, the relationship matches a first relationship R1 passing through the first set point and a reference point that is the origin point or a point in its vicinity;

(2) when the ambient-light illuminance is the particular illuminance Is, a point on the first relationship R1 is defined as a particular point S; and (3) in a range in which the ambient-light illuminance is smaller than the particular illuminance Is, the relationship is a second relationship R2 passing through a second set point and the particular point S.

The following method also can realize the invention according to the second embodiment.

That is, a display method includes a display step of displaying, by a display, an image, an illuminance acquisition step of acquiring, by an illuminance acquisition unit, an ambient-light illuminance that is an illuminance of ambient light, a relationship acquisition step of acquiring, by a relationship acquisition unit, a relationship between the ambient-light illuminance and a luminance of the display, a control step of controlling, by a controller, the relationship, and a setting step of setting, by a setting unit, a first set point and a second set point. The first set point is a point specified by a luminance set at an illuminance equal to or greater than a particular illuminance Is and the illuminance. The second set point is a point specified by a luminance set at an illuminance smaller than the particular illuminance Is and the illuminance. The relationship is controlled by the controller so that the relationship satisfies conditions including:

(1) in a range in which the ambient-light illuminance is equal to or greater than the particular illuminance Is, the relationship matches a first relationship R1 passing through the first set point and a reference point that is the origin point or a point in a vicinity thereof;

(2) when the ambient-light illuminance is the particular illuminance Is, a point on the first relationship R1 is defined as a particular point S; and (3) in a range in which the ambient-light illuminance is smaller than the particular illuminance Is, the relationship is a second relationship R2 passing through the second set point and the particular point S.

DESCRIPTION OF REFERENCE SIGNS

1: display device
2: operation unit
3: display
4: communication unit
5: illuminance sensor
10: processor
11: illuminance acquisition unit
12: luminance controller
13: minimum luminance changer
14: relationship acquisition unit
15: relationship update unit
15*b*: controller
16: setting unit
20: storage unit
21: relationship storage unit
22: program

The invention claimed is:

1. A display device comprising:

a display, an illuminance acquisition unit configured to acquire an ambient-light illuminance that is an illuminance of ambient light;

a relationship acquisition unit configured to acquire a relationship between the ambient-light illuminance and a luminance of the display;

a controller configured to control the relationship; and a setting unit configured to set a first set point and a second set point, wherein the first set point is a point specified by a luminance set at an illuminance equal to or greater than a particular illuminance Is and the illuminance, the second set point is a point specified by a luminance set at an illuminance smaller than the particular illuminance Is and the illuminance, the relationship is controlled by the controller so that the relationship satisfies the conditions (1) to (3):

(1) in a range in which the ambient-light illuminance is equal to or greater than the particular illuminance Is, the relationship matches a first relationship R1 passing through the first set point and a reference point that is the origin point or a point in a vicinity thereof;

(2) when the ambient-light illuminance is the particular illuminance Is, a point on the first relationship R1 is defined as a particular point S; and (3) in a range in which the ambient-light illuminance is smaller than the particular illuminance Is, the relationship is a second relationship R2 passing through the second set point and the particular point S, and the relationship is controlled by the controller so that the relationship satisfies the conditions (A) or (B), (A) when the second set point is changed and a luminance of the particular point S falls below a luminance of the changed second set point, the relationship is controlled so that the relationship satisfies conditions comprising:

(6) a point on the first relationship R1 having the same luminance as the luminance of a changed second set point is set as a third set point; and (7) in a range in which the ambient-light illuminance is equal to or greater than an illuminance of the third set point, the relationship matches the first relationship R1; and (8) in a range in which the ambient-light illuminance is equal to or smaller than the illuminance of the third set point, the relationship becomes the same luminance as a luminance of the third set point, (B) when the first set point is changed and a luminance of the changed first set point falls below a luminance of the second set point, the relationship is controlled so that the relationship satisfies conditions comprising:

(9) in a range in which the ambient-light illuminance is equal to or greater than an illuminance of a changed first set point, the relationship matches a third relationship R3 passing through the changed first set point and the origin point or the reference point; and

(10) in a range in which the ambient-light illuminance is equal to or smaller than the illuminance of the changed first set point, the relationship becomes same luminance as the luminance of the changed first set point.

2. The display device of claim 1, wherein an inclination of the first relationship R1 passing through the first set point and the particular point S is set so as to be greater than an inclination of the second relationship R2 passing through the second set point and the particular point S.

3. The display device of claim 1, wherein when the second set point is changed, the relationship is controlled so that the relationship satisfies conditions comprising:

(4) the first relationship R1 is not changed in a range in which the ambient-light illuminance is equal to or greater than the particular illuminance Is; and (5) the second relationship R2 is changed so as to pass through the changed second set point and the particular point S.

4. The display device of claim 1, wherein the particular illuminance Is is an illuminance determined on a basis of a sensory evaluation and is an illuminance when the display is sensed to be dark while the ambient-light illuminance is reduced with liner characteristics.

5. The display device of claim 1, further comprising a luminance controller configured to control the luminance of the display on the basis of the ambient-light illuminance and the first relationship R1 or the second relationship R2.

6. A display device comprising:

a display;

an illuminance acquisition unit configured to acquire an ambient-light illuminance that is an illuminance of ambient light; and a relationship acquisition unit configured to acquire a relationship between the ambient-light illuminance and a luminance of the display, wherein the relationship is set such that the luminance becomes a minimum luminance Ym when the ambient-light illuminance is smaller than a predetermined lower-limit illuminance Im, and the luminance becomes a maximum luminance YM when the ambient-light illuminance exceeds a predetermined upper-limit illuminance IM, and when the minimum luminance Ym is changed from a first minimum luminance Yml to a second minimum luminance Ym2 greater than the first minimum luminance Ym1, the relationship is controlled so that the relationship satisfies conditions comprising:

(1) when the minimum luminance Ym is the first minimum luminance Ym1, a relationship between the illuminance and the luminance in a range between the lower-limit illuminance Im and the upper-limit illuminance IM is defined as a first relationship R1;

(2) in a range in which the ambient-light illuminance exceeds a predetermined intermediate illuminance, the first relationship R1 is not changed;

(3) the intermediate illuminance is an illuminance between the lower-limit illuminance Im and the upper-limit illuminance IM;

(4) the first relationship R1 is changed to a second relationship R2 in a range between the lower-limit illuminance Im and the intermediate illuminance; and (5) the second relationship R2 is generated such that a luminance specified by the second relationship R2 falls within a predetermined luminance range from the second minimum luminance Ym2 regardless of a value of the second minimum luminance Ym2.

7. The display device of claim 6, wherein the second relationship R2 is set such that the luminance in a range between the lower-limit illuminance Im and the intermediate illuminance does not exceed a luminance at the intermediate illuminance.

8. The display device of claim 6, wherein the second relationship R2 is set such that the luminance does not decrease with an increase in the illuminance in a range between the lower-limit illuminance Im and the intermediate illuminance.

9. The display device of claim 6, wherein the second relationship R2 is set such that the luminance in a range between the lower-limit illuminance Im and the intermediate illuminance becomes the second minimum luminance Ym2.

10. The display device of claim 6, wherein the first relationship R1 is a monotone non-decrease function.

11. A non-transitory computer-readable storage medium storing a program for causing a computer to function as:

a display;

an illuminance acquisition unit configured to acquire an ambient-light illuminance that is an illuminance of ambient light;

a relationship acquisition unit configured to acquire a relationship between the ambient-light illuminance and a luminance of the display;

a controller configured to control the relationship; and a setting unit configured to set a first set point and a second set point, wherein the first set point is a point specified by a luminance set at an illuminance equal to or greater than a particular illuminance Is and the illuminance, the second set point is a point specified by a luminance set at an illuminance smaller than the particular illuminance Is and the illuminance, the relationship is controlled by the controller so that the relationship satisfies the conditions (1) to (3):

(1) in a range in which the ambient-light illuminance is equal to or greater than the particular illuminance Is, the relationship matches a first relationship R1 passing through the first set point and a reference point that is the origin point or a point in a vicinity thereof;

(2) when the ambient-light illuminance is the particular illuminance Is, a point on the first relationship R1 is defined as a particular point S; and (3) in a range in which the ambient-light illuminance is smaller than the particular illuminance Is, the relationship is a second relationship R2 passing through the second set point and the particular point S, and the relationship is controlled by the controller so that the relationship satisfies the conditions (A) or (B), (A) when the second set point is changed and a luminance of the particular point S falls below a luminance of the changed second set point, the relationship is controlled so that the relationship satisfies conditions comprising:

(6) a point on the first relationship R1 having the same luminance as the luminance of a changed second set point is set as a third set point; and (7) in a range in which the ambient-light illuminance is equal to or greater than an illuminance of the third set point, the relationship matches the first relationship R1; and (8) in a range in which the ambient-light illuminance is equal to or smaller than the illuminance of the third set point, the relationship becomes the same luminance as a luminance of the third set point, (B) when the first set point is changed and a luminance of the changed first set point falls below a luminance of the second set point, the relationship is controlled so that the relationship satisfies conditions comprising:

(9) in a range in which the ambient-light illuminance is equal to or greater than an illuminance of a changed first set point, the relationship matches a third relationship R3 passing through the changed first set point and the origin point or the reference point; and

(10) in a range in which the ambient-light illuminance is equal to or smaller than the illuminance of the changed first set point, the relationship becomes same luminance as the luminance of the changed first set point.

12. A display method comprising:

a display step of displaying, by a display, an image;

an illuminance acquisition step of acquiring, by an illuminance acquisition unit, an ambient-light illuminance that is an illuminance of ambient light;

a relationship acquisition step of acquiring, by a relationship acquisition unit, a relationship between the ambient-light illuminance and a luminance of the display;

a control step of controlling, by a controller, the relationship; and a setting step of setting, by a setting unit, a first set point and a second set point, wherein the first set point is a point specified by a luminance set at an illuminance equal to or greater than a particular illuminance Is and the illuminance, the second set point is a point specified by a luminance set at an illuminance smaller than the particular illuminance Is and the illuminance, the relationship is controlled by the controller so that the relationship satisfies the conditions (1) to (3):

(1) in a range in which the ambient-light illuminance is equal to or greater than the particular illuminance Is, the relationship matches a first relationship R1 passing through the first set point and a reference point that is the origin point or a point in a vicinity thereof;

(2) when the ambient-light illuminance is the particular illuminance Is, a point on the first relationship R1 is defined as a particular point S; and (3) in a range in which the ambient-light illuminance is smaller than the particular illuminance Is, the relationship is a second relationship R2 passing through the second set point and the particular point S, and the relationship is controlled by the controller so that the relationship satisfies the conditions (A) or (B), (A) when the second set point is changed and a luminance of the particular point S falls below a luminance of the changed second set point, the relationship is controlled so that the relationship satisfies conditions comprising:

(6) a point on the first relationship R1 having the same luminance as the luminance of a changed second set point is set as a third set point; and (7) in a range in which the ambient-light illuminance is equal to or greater than an illuminance of the third set point, the relationship matches the first relationship R1; and (8) in a range in which the ambient-light illuminance is equal to or smaller than the illuminance of the third set point, the relationship becomes the same luminance as a luminance of the third set point, (B) when the first set point is changed and a luminance of the changed first set point falls below a luminance of the second set point, the relationship is controlled so that the relationship satisfies conditions comprising:

(9) in a range in which the ambient-light illuminance is equal to or greater than an illuminance of a changed first set point, the relationship matches a third relationship R3 passing through the changed first set point and the origin point or the reference point; and

(10) in a range in which the ambient-light illuminance is equal to or smaller than the illuminance of the changed first set point, the relationship becomes same luminance as the luminance of the changed first set point.

* * * * *